US009059512B2

(12) United States Patent
Lee et al.

(10) Patent No.: US 9,059,512 B2
(45) Date of Patent: Jun. 16, 2015

(54) RADIO COMMUNICATION ANTENNA AND RADIO COMMUNICATION DEVICE

(71) Applicant: Electronics and Telecommunications Research Institute, Daejeon (KR)

(72) Inventors: Sang Seok Lee, Chungcheongnam-do (KR); Seongdeok Ahn, Daejeon (KR); Jae Bon Koo, Daejeon (KR)

(73) Assignee: ELECTRONICS AND TELECOMMUNICATIONS RESEARCH INSTITUTE, Deajeon ( * ) Notice: Subject to any disclaimer, the term of this patent is extended or adjusted under 35 U.S.C. 154(b) by 0 days.

(21) Appl. No.: 13/929,735

(22) Filed: Jun. 27, 2013

(65) Prior Publication Data

US 2014/0086289 A1 Mar. 27, 2014

(30) Foreign Application Priority Data

Sep. 24, 2012 (KR) ..... 10-2012-0105916
Mar. 15, 2013 (KR) ..... 10-2013-0028125

(51) Int. Cl.
*H01Q 5/02* (2006.01)
*H01Q 9/16* (2006.01)
*H01Q 9/06* (2006.01)

(52) U.S. Cl.
CPC ..... *H01Q 5/378* (2015.01); *H01Q 9/065* (2013.01); *H01Q 9/16* (2013.01); *H01Q 5/48* (2015.01)

(58) Field of Classification Search
CPC ..... H01Q 9/285; H01Q 1/38; H01Q 9/28
USPC ..... 343/700 MS, 795, 818
See application file for complete search history.

(56) References Cited

U.S. PATENT DOCUMENTS

| | | | | |
|---|---|---|---|---|
| 2,283,938 | A * | 5/1942 | McKesson | 343/733 |
| 3,371,348 | A * | 2/1968 | Simons | 343/807 |
| 3,509,575 | A * | 4/1970 | Noriyuki et al. | 343/795 |
| 6,061,025 | A * | 5/2000 | Jackson et al. | 343/700 MS |
| 2006/0214867 | A1 * | 9/2006 | Chen | 343/795 |
| 2007/0279287 | A1 * | 12/2007 | Castaneda et al. | 343/700 MS |
| 2008/0129606 | A1 * | 6/2008 | Yanagisawa et al. | 343/700 MS |

FOREIGN PATENT DOCUMENTS

| | | | |
|---|---|---|---|
| KR | 10-2007-0017383 | A | 2/2007 |
| KR | 10-2008-0040512 | A | 5/2008 |
| KR | 10-2011-0042902 | A | 4/2011 |

* cited by examiner

*Primary Examiner* — Robert Karacsony
*Assistant Examiner* — Daniel J Munoz

(57) ABSTRACT

The present invention relates to a radio communication antenna and a radio communication device including the same. The radio communication antenna of the present invention includes first conductive wires extending in opposite directions with respect to a first direction on a substrate to form a dipole antenna, second conductive wires separated from the first conductive wires to be parallel with the first conductive wires, and stubs connected between the first conductive wires and the second conductive wires in a second direction intersecting with the first direction.

8 Claims, 6 Drawing Sheets

<Prior Art>

<Prior Art>

RADIO COMMUNICATION ANTENNA AND RADIO COMMUNICATION DEVICE

CROSS-REFERENCE TO RELATED APPLICATIONS

This U.S. non-provisional patent application claims priority under 35 U.S.C. §119 of Korean Patent Application Nos. 10-2012-0105916, filed on Sep. 24, 2012, and 10-2013-0028125, filed on Mar. 15, 2013, the entire contents of which are hereby incorporated by reference.

BACKGROUND OF THE INVENTION

The present invention disclosed herein relates to a radio communication antenna and a radio communication device, and more particularly, to a dipole antenna and a radio communication antenna including the dipole antenna.

In a radio communication system, without an additional signal propagation medium such as a conductive wire or an optical fiber, signals are transmitted and received through the atmosphere to perform communication. There are radio communication technologies such as amplitude modulation (AM), frequency modulation (FM), phase modulation (PM), amplitude shift keying (ASK), frequency shift keying (FSK), phase shift keying (PSK), code division multiple access (CDMA), and orthogonal frequency division multiplexing (OFDM).

An antenna is necessary to transmit or receive a signal through the atmosphere. The antenna has a structure based on a wavelength of a communication frequency. Such an antenna having polarities that oppose each other about a center of the antenna so as to operate as a dipole may be referred to as a dipole antenna. A length of a dipole of the dipole antenna is adjusted so as to tune a center frequency with a wavelength. In a recent radio communication system, a mobile communication terminal using a local area network complexly uses various types of communication networks such as Bluetooth and WiFi. In order to use these various types of communication networks, it is necessary to use a plurality of antennas or a broadband antenna. A typical dipole antenna is simple in terms of a configuration. However, it is difficult to apply the typical dipole antenna to broadband communications.

SUMMARY OF THE INVENTION

The present invention provides a radio communication antenna and a radio communication device for broadband radio communications.

Embodiments of the inventive concept provide radio communication antennas including first conductive wires extending in opposite directions with respect to a first direction on a substrate to form a dipole antenna; second conductive wires separated from the first conductive wires to be parallel with the first conductive wires; and stubs connected between the first conductive wires and the second conductive wires in a second direction intersecting with the first direction.

In some embodiments, the first conductive wires may include: a plurality of vertical conductive wires vertically connected to the substrate; and a plurality of horizontal conductive wires connected to the vertical conductive wires to extend in parallel with the substrate.

In other embodiments, the second conductive wires may have the same lengths and widths as the plurality of horizontal conductive wires.

In still other embodiments, the stubs may be connected between the horizontal conductive wires and the second conductive wires and may be concentrated to one sides of the horizontal conductive wires and the second conductive wires adjacent the vertical conductive wires.

In even other embodiments, the horizontal conductive wires and the second conductive wires may have a first resonant frequency of a main frequency band.

In yet other embodiments, the stubs may have a second resonant frequency of an auxiliary frequency band lower than the main frequency band.

In further embodiments, the second resonant frequency may overlap with the first resonant frequency.

In still further embodiments, the second resonant frequency may vary with lengths and widths of the stubs.

In even further embodiments, the substrate may include plastic.

In other embodiments of the inventive concept, radio communication devices include: a radio communication antenna; a modem connected to the radio communication antenna to perform modulation and demodulation; a memory; a user interface; and a processor configured to control the modem, the memory, and the user interface, wherein the radio communication antenna includes first conductive wires extending in opposite directions with respect to a first direction on a substrate to form a dipole antenna, second conductive wires separated from the first conductive wires to be parallel with the first conductive wires, and stubs connected between the first conductive wires and the second conductive wires in a second direction intersecting with the first direction.

In some embodiments, broadband radio communication may be performed using the radio communication antenna.

BRIEF DESCRIPTION OF THE DRAWINGS

The accompanying drawings are included to provide a further understanding of the present invention, and are incorporated in and constitute a part of this specification. The drawings illustrate exemplary embodiments of the inventive concept and, together with the description, serve to explain principles of the present invention. In the drawings.

DETAILED DESCRIPTION OF PREFERRED EMBODIMENTS

Preferred embodiments of the inventive concept will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Figure 1:
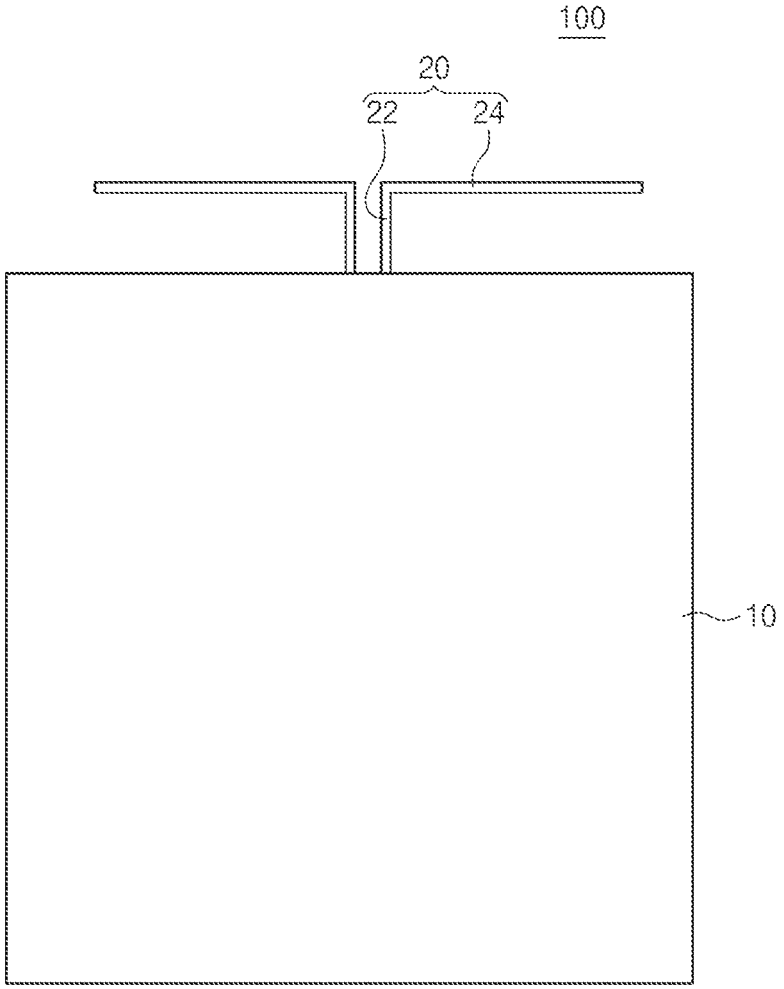
FIG. 1 is a perspective view illustrating a radio communication antenna according to an embodiment of the present invention.

FIG. 1 is a diagram illustrating a typical radio communication antenna 100.

Referring to FIG. 1, the typical radio communication antenna 100 may include a substrate 10 and first conductive wires 20. The substrate 10 may be formed of a plastic material. The first conductive wires 20 may include a plurality of vertical conductive wires 22 and a plurality of horizontal conductive wires 24. The vertical conductive wires 22 and the horizontal conductive wires 24 may be symmetrical to each other so as to configure a dipole antenna.

Figure 2:
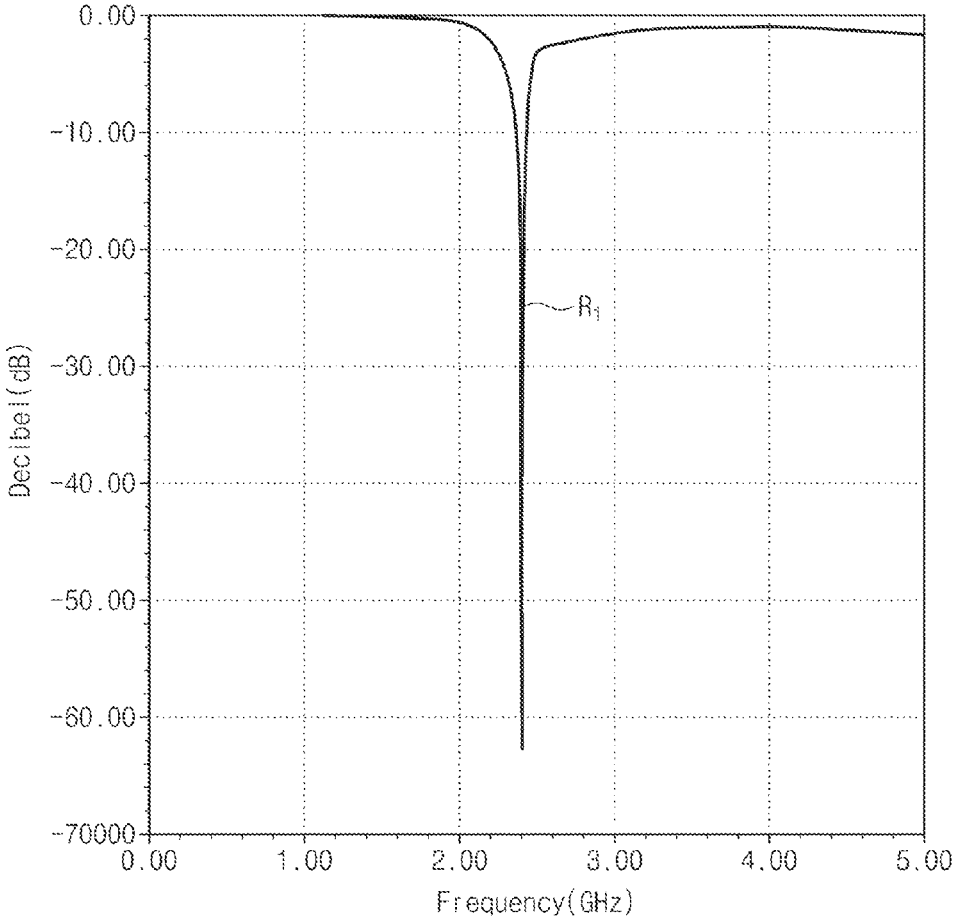
FIG. 2 is a graph illustrating a first example of a communication frequency of the radio communication antenna of FIG. 1.

FIG. 2 is a graph illustrating a communication frequency of the typical radio communication antenna of FIG. 1.

Referring to FIGS. 1 and 2, the typical radio communication antenna 100 may have a first resonant frequency R1 of about 0.4 GHz band from about 2.2 GHz to about 2.6 GHz. A communication frequency of the first resonant frequency R1 may be determined by a dielectric constant and a thickness of the substrate 10, materials, electric conductivity, thicknesses, widths, and lengths of the first conductive wires 20, or distances between the first conductive wires 20. The first resonant frequency R1 may have a narrowband.

Therefore, the typical radio communication antenna may have the first resonant frequency R1 of narrowband.

Figure 3:
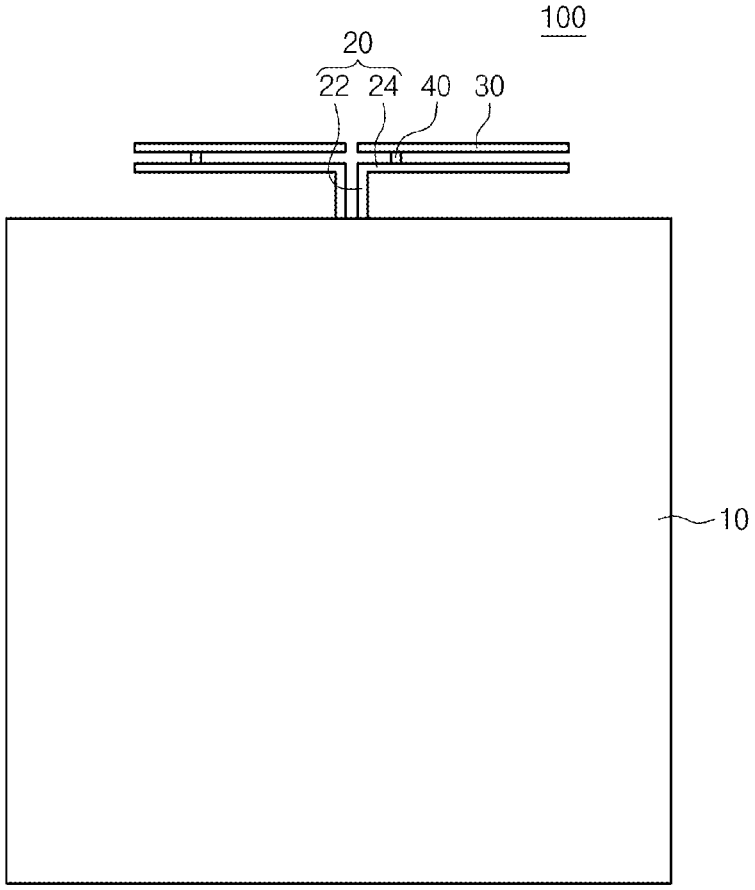
FIG. 3 is a diagram illustrating a radio communication antenna according to an embodiment.
Figure 4:
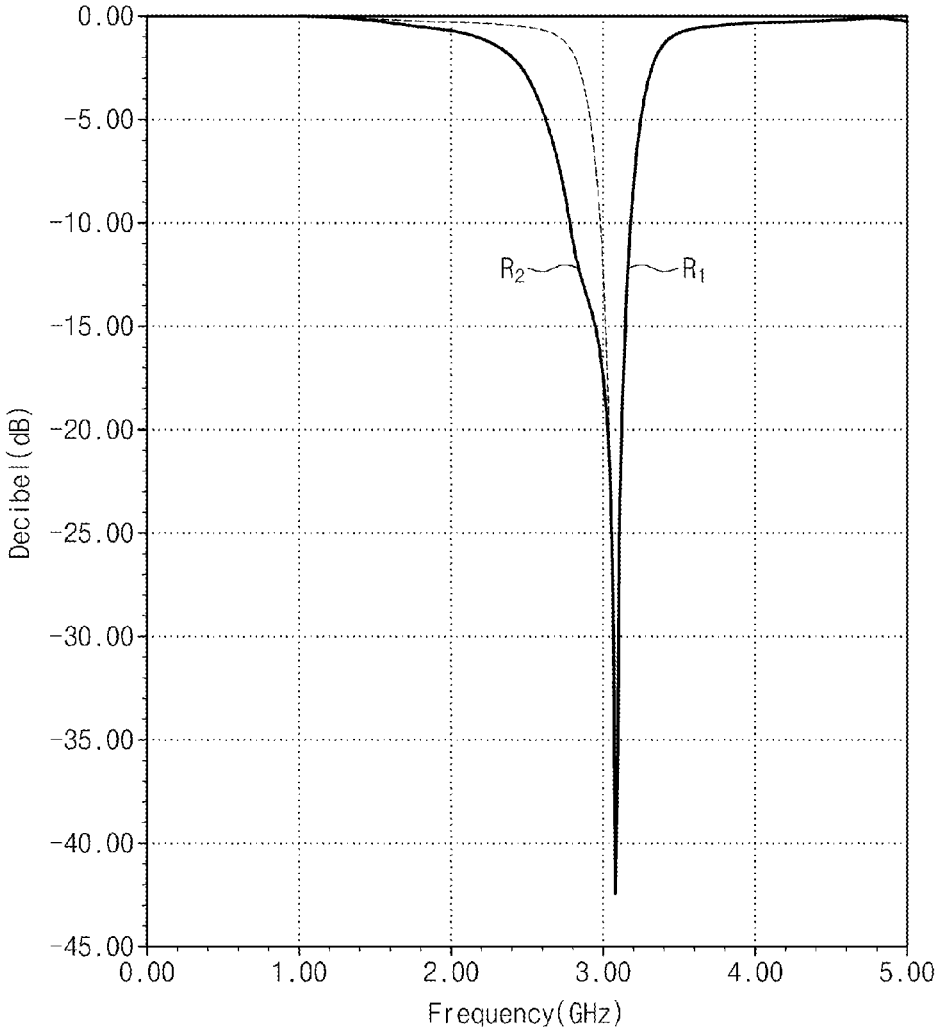
FIG. 4 is a graph illustrating a communication frequency of the radio communication antenna of FIG.3.

FIG. 3 is a diagram illustrating a radio communication antenna according to an embodiment of the present invention. FIG. 4 is a graph illustrating a communication frequency of a radio communication antenna 100 of FIG. 3.

Referring to FIGS. 3 and 4, the radio communication antenna 100 may include a substrate 10, first conductive wires 20, second conductive wires 30, and stubs 40. The substrate 10 may include an insulating material such as plastic.

The first conductive wires 20 may include symmetrical vertical conductive wires 22 and horizontal conductive wires 24. The vertical conductive wires 22 may be connected in a second direction vertical to the substrate 10. The horizontal conductive wires 24 may be extended from ends of the vertical conductive wires 22 in a first direction parallel to the substrate 10.

The second conductive wires 30 are parallel to the horizontal conductive wires 24 and may have the same length and same width. The second conductive wires 30 and the horizontal conductive wires 24 may have a first resonant frequency (R1) of a main polar frequency (MP) band. As described above, the first resonant frequency R1 may have a narrowband.

The stubs 40 may have a second resonant frequency R2 of an auxiliary polar frequency (AP) band. The second resonant frequency R2 may be lower than the first resonant frequency R1. The stubs 40 may move the second resonant frequency R2 of the auxiliary polar frequency band to the first resonant frequency R1 of the main polar frequency band so as to partially superimpose the second resonant frequency R2 to the first resonant frequency R1. The second resonant frequency R2 may vary with lengths, thicknesses, widths, and distances of the stubs 40. The stubs 40 may be connected between the horizontal conductive wires 24 and the second conductive wires 30. The stubs 40 may be asymmetrically arranged. The stubs 40 may be concentrated to one sides of the horizontal conductive wires 24 and the second conductive wires 30 adjacent the vertical conductive wires 22.

The first and second resonant frequencies R1 and R2 may be broadband resonant frequencies. For example, the broadband resonant frequency may have a broadband of about 1.2 GHz from about 2.2 GHz to about 3.4 GHz. The broadband resonant frequency may enable broader-band radio communication in comparison with the narrowband resonant frequency.

Therefore, the radio communication antenna 100 according to an embodiment of the present invention may realize broadband radio communication. The radio communication antenna 100 may support Bluetooth and WiFi communications having broadband resonant frequencies.

Figure 5:
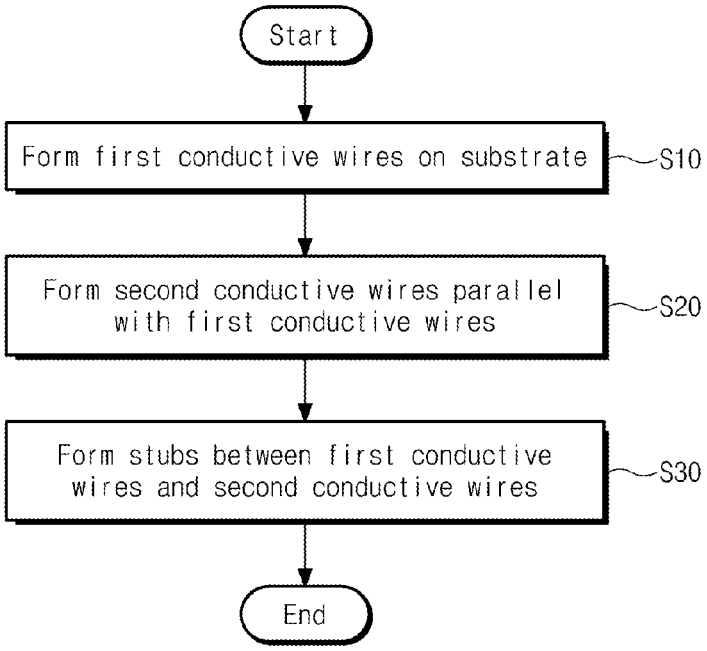
FIG. 5 is a flowchart illustrating a method of manufacturing a radio communication antenna.

FIG. 5 is a flowchart illustrating a method of manufacturing the radio communication antenna 100.

Referring to FIGS. 3 and 5, the first conductive wires 20 are symmetrically formed on the substrate 10 in operation S10. The first conductive wires 20 may be formed by a metal vapor deposition process, a photolithography process, and an etching process.

Next, the second conductive wires 30 that are parallel to the horizontal conductive wires 24 of the first conductive wires 20 are formed in operation S20. The second conductive wires 30 may be composed of the same metal material as the first conductive wires 20. The second conductive wires 30 may be formed by a metal vapor deposition process, a photolithography process, and an etching process.

Next, the stubs 40 are formed between the second conductive wires 30 and the horizontal conductive wires 24. The stubs 40 may be formed by a metal vapor deposition process, a photolithography process, and an etching process. The stubs 40 may be formed before the second conductive wires 20, or may be formed at the same time when the second conductive wires 20 are formed.

The present invention is not limited to the above description, and may be variously modified. For example, the first conductive wires 20, the second conductive wires 30, and the stubs 40 may be formed on the substrate 10 by performing a metal vapor deposition process, a photolithography process, and an etching process once.

Figure 6:
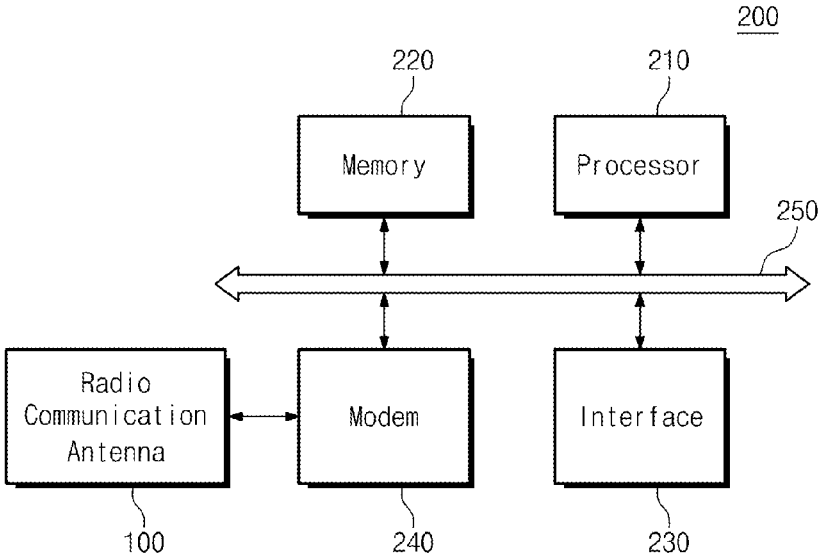
FIG. 6 is a block diagram illustrating a radio communication device according to an embodiment of the present invention.

FIG. 6 is a block diagram illustrating a radio communication device 200 according to an embodiment of the present invention. Referring to FIG. 6, the radio communication device 200 includes a processor 210, a memory 220, an interface 230, a modem 240, a bus 250, and the radio communication antenna 100.

The processor 210 may control an overall operation of the radio communication device 200. The processor 210 may control the radio communication device 200 so as to perform radio communication.

The memory 220 may be an operating memory of the radio communication device 200. The memory 220 may store data to be processed by the processor 210, data processed by the processor 210, data to be modulated by the modem 240, and data demodulated by the modem 240. The memory 220 may include a volatile memory such as a static RAM (SRAM), a dynamic RAM (DRAM), and a synchronous DRAM (SDRAM) or a nonvolatile memory such as a read only memory (ROM), a programmable ROM (PROM), an electrically programmable ROM (EPROM), an electrically erasable and programmable ROM (EEPROM), a flash memory, a phase-change RAM (PRAM), a magnetic RAM (MRAM), a resistive RAM (RRAM), and a ferroelectric RAM (FRAM).

The interface 230 may exchange signals with the outside. For example, the interface 230 may receive, from the outside, data to be transmitted through radio communication and may output the received data to the outside. The interface 230 may be a communication port for exchanging data with an external device. The interface 230 may include a user input interface for receiving data from a user, such as a keyboard, a keypad, a touchpad, a button, a mouse, a camera, and a microphone. The interface 230 may include a user output interface for outputting data to the user, such as a speaker, a monitor, a lamp, and a liquid crystal display device.

The modem 240 may modulate data to be transmitted through radio communication and may demodulate data received through radio communication. The modem 240 may perform the modulation and demodulation operations according to communication schemes such as amplitude modulation (AM), frequency modulation (FM), phase modulation (PM), amplitude shift keying (ASK), frequency shift keying (FSK), phase shift keying (PSK), code division multiple access (CDMA), and orthogonal frequency division multiplexing (OFDM).

The modem 240 may perform radio communication according to various radio communication standards such as Bluetooth and WiFi.

The bus 250 provides a channel between the processor 210, the memory 220, the interface, 230, and the modem 240.

The radio communication antenna 100 is connected to the modem 240. The radio communication antenna 100 may convert an electric signal transmitted from the modem 240 into a radio signal in order to propagate the radio signal through the atmosphere. The radio communication antenna 100 may convert the radio signal propagated through the atmosphere into the electric signal in order to transmit the electric signal to the modem 240.

As described above with reference to FIG. 3, the radio communication antenna 100 may include the substrate 10, the first conductive wires 20 on the substrate 10, the second conductive wires 30 parallel to the horizontal conductive wires 24 of the first conductive wires, and the stubs 40 connected to the second conductive wires 30 and the horizontal conductive wires 24.

As described above with reference to FIGS. 4 and 6, the radio communication device 200 may have a broadband resonant frequency. The radio communication antenna 200 may perform radio communication according to two communication standards using different frequency bands such as Bluetooth and WiFi.

The radio communication antenna according to an embodiment of the present invention may include the first conductive wires on the substrate, the second conductive wires, and the stubs. The first conductive wires may include the vertical conductive wires connected to the substrate and the horizontal conductive wires connected to the vertical conductive wires. The second conductive wires are parallel to the horizontal conductive wires and may have the same lengths and same widths as the horizontal conductive wires. The second conductive wires and the horizontal conductive wires may have the first resonant frequency of the main polar frequency band. The stubs may connect the second conductive wires to the horizontal conductive wires. The stubs may have the second resonant frequency of the auxiliary polar frequency band lower than the first resonant frequency. The first and second resonant frequencies may overlap with each other.

Therefore, the radio communication antenna according to an embodiment of the present invention may realize broadband radio communication in which the first and second resonant frequencies overlap with each other.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A radio communication antenna comprising:

a plurality of vertical conductive wires vertically connected to a substrate;

first conductive wires extending from ends of the vertical conductive wires in opposite directions with respect to a first direction on the substrate to form a dipole antenna;

second conductive wires separated from the first conductive wires to be parallel with the first conductive wires; and stubs connected between the first conductive wires and the second conductive wires in a second direction intersecting with the first direction, wherein each stub is connected to a respective first conductive wire different from first conductive wires connected to any other stubs, wherein each stub is connected to the respective first conductive wire at a location other than an end of the respective first conductive wire, wherein each stub is connected to a respective second conductive wire different from second conductive wires connected to any other stubs, wherein each stub is connected to the respective second conductive wire at a location other than an end of the respective second conductive wire, wherein the second conductive wires have same lengths and widths as the first conductive wires, and wherein the stubs are asymmetrically arranged.

2. The radio communication antenna of claim 1, wherein the horizontal conductive wires and the second conductive wires have a first resonant frequency of a main frequency band.

3. The radio communication antenna of claim 2, wherein the stubs have a second resonant frequency of an auxiliary frequency band lower than the main frequency band.

4. The radio communication antenna of claim 3, wherein the second resonant frequency overlaps with the first resonant frequency.

5. The radio communication antenna of claim 3, wherein the second resonant frequency varies with lengths and widths of the stubs.

6. The radio communication antenna of claim 1, wherein the substrate comprises plastic.

7. A radio communication device comprising:

a radio communication antenna;

a modem connected to the radio communication antenna to perform modulation and demodulation;

a memory;

a user interface; and a processor configured to control the modem, the memory, and the user interface, wherein the radio communication antenna comprises:

a plurality of vertical conductive wires vertically connected to a substrate, first conductive wires extending from ends of the vertical conductive wires in opposite directions with respect to a first direction on the substrate to form a dipole antenna, second conductive wires separated from the first conductive wires to be parallel with the first conductive wires, and stubs connected between the first conductive wires and the second conductive wires in a second direction intersecting with the first direction, wherein each stub is connected to a respective first conductive wire different from first conductive wires connected to any other stubs, wherein each stub is connected to the respective first conductive wire at a location other than an end of the respective first conductive wire, wherein each stub is connected to a respective second conductive wire different from second conductive wires connected to any other stubs, wherein each stub is connected to the respective second conductive wire at a location other than an end of the respective second conductive wire, wherein the second conductive wires have same lengths and widths as the first conductive wires, and wherein the stubs are asymmetrically arranged.

8. The radio communication device of claim 7, wherein broadband radio communication is performed using the radio communication antenna.

* * * * *